US005755372A

United States Patent [19]

Cimbura, Sr.

[11] Patent Number: 5,755,372

[45] Date of Patent: May 26, 1998

[54] SELF MONITORING OIL PUMP SEAL

[75] Inventor: John Alan Cimbura, Sr., Ventura, Calif.

[73] Assignee: Ocean Engineering & Manufacturing, Inc., Ventura, Calif.

[21] Appl. No.: 504,776

[22] Filed: Jul. 20, 1995

[51] Int. Cl.[6] ..... F16J 15/18

[52] U.S. Cl. ..... 277/318; 277/320; 277/329; 277/518; 277/529; 277/562; 277/914

[58] Field of Search ..... 277/2, 3, 27, 59, 277/64, 66, 73 R, 123, 152, 153, 165, 205, 208, 214; 166/68.5, 84.1

[56] References Cited

U.S. PATENT DOCUMENTS

| | | | |
|---|---|---|---|
| Re. 34,923 | 5/1995 | Ruesch | 277/2 |
| 1,425,268 | 8/1922 | Massa | 277/153 |
| 1,982,252 | 11/1934 | Heggem | 277/64 |
| 2,211,122 | 8/1940 | Howard | 277/64 |
| 2,853,321 | 9/1958 | Davey | 277/64 |
| 3,474,734 | 10/1969 | Stogner | 277/59 |
| 3,854,737 | 12/1974 | Gilliam, Sr. | 277/205 |
| 3,866,924 | 2/1975 | French | 277/59 |
| 4,178,133 | 12/1979 | Rawicki | 277/2 |
| 4,337,956 | 7/1982 | Hopper | 277/152 |
| 4,716,961 | 1/1988 | Makins, Jr. et al. | 166/68.5 |
| 4,878,677 | 11/1989 | Larkins et al. | 277/59 |
| 5,137,083 | 8/1992 | Bump | 277/59 |
| 5,165,700 | 11/1992 | Stoll et al. | 277/152 |
| 5,230,498 | 7/1993 | Wood et al. | 277/2 |
| 5,263,682 | 11/1993 | Covert et al. | 277/2 |
| 5,647,598 | 7/1997 | Vaudolon | 277/59 |

*Primary Examiner*—William A. Cuchlinski, Jr.
*Assistant Examiner*—John L. Beres
*Attorney, Agent, or Firm*—Marvin E. Jacobs

[57] ABSTRACT

A seal system for an oil well head, wherein the shaft rotates about its axis to drive a progressive cavity type pump. Primary and secondary polytetrafluoroethylene seals surround a sleeve that encircles the shaft. Pressure detectors connect to the space between the seals to detect leaks past the primary seal and signal a remote repair facility. The secondary seal assumes the sealing function while repairs are scheduled.

17 Claims, 1 Drawing Sheet

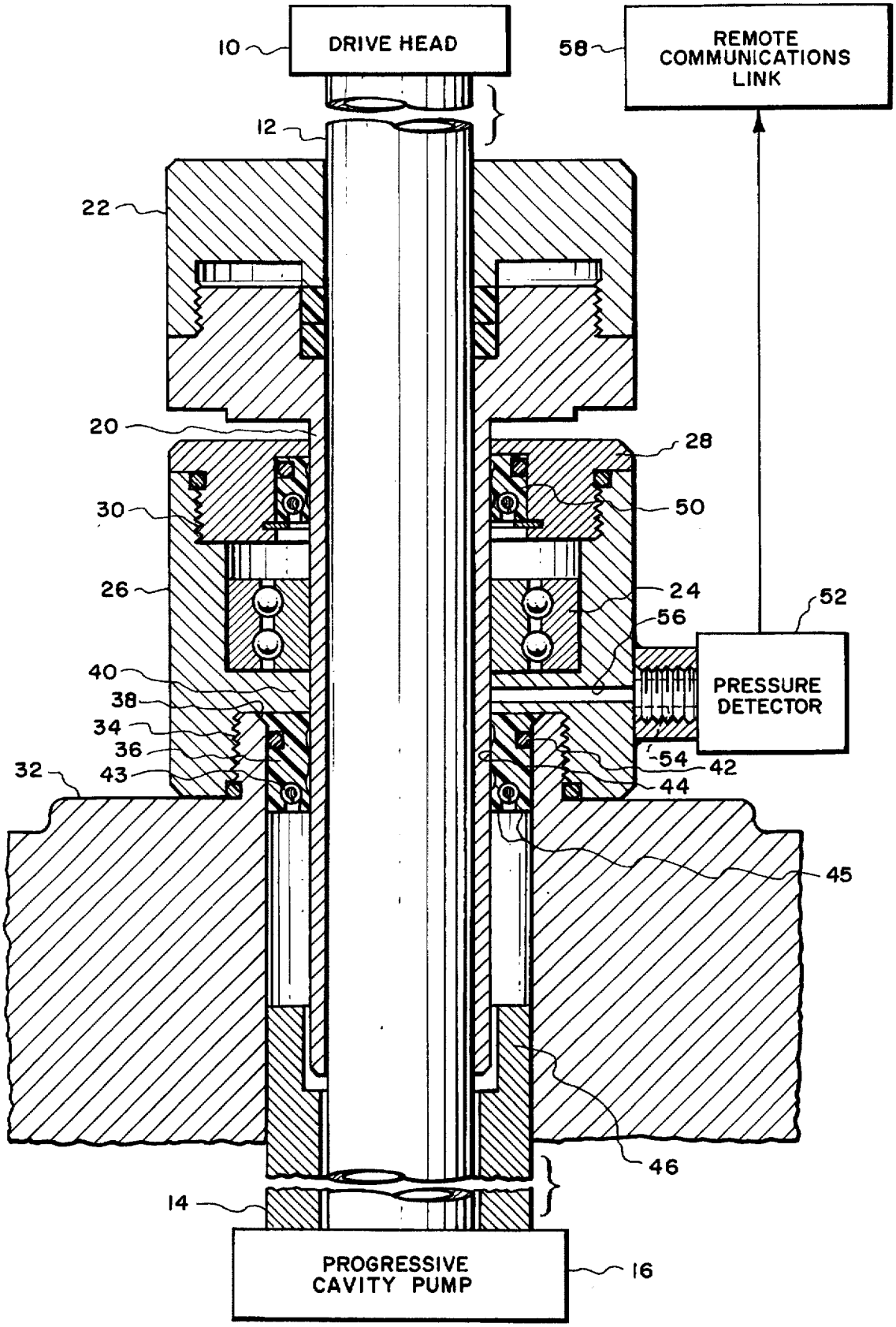
DRIVE HEAD
REMOTE COMMUNICATIONS LINK
PRESSURE DETECTOR
PROGRESSIVE CAVITY PUMP
10
12
14
16
20
22
24
26
28
30
32
34
36
38
40
42
43
44
45
46
50
52
54
56
58

SELF MONITORING OIL PUMP SEAL

TECHNICAL FIELD

This invention relates to highly reliable seals for remote oil wells that are hard to maintain. More specifically, this invention concerns redundant, self monitoring seals for high speed rotating shafts used with progressive cavity type oil well pumps.

BACKGROUND OF THE INVENTION

This invention is an improvement to an earlier oil pump shaft seal described in patent application Ser. No. 08/430,894, filed Apr. 27, 1995, by the same inventor, now abandoned and the teachings of that earlier patent are incorporated herein by reference.

Prior art seals for oil wells used a rope packing wrapped about the shaft and impregnated with grease which had to be routinely maintained by tightening a compression nut above the packing material so as to squeeze it more tightly against the pump shaft. This wears out quickly. My above referenced abandoned application disclosed a seal which utilizes a carbon and graphite filled polytetrafluoroethylene (PTFE) material that bears against a very hard and smooth sleeve, which sleeve is slipped over the pump drive shaft and sealed and locked thereto. The sleeve is prepared by flame spraying a powdered metal alloy onto the sleeve and then machining it to the necessary smoothness to withstand the leakage of the corrosive and poisonous gas found in many oil reserves. To allow this precision sealing surface to withstand the movement of the long, often unbalanced, drive shaft, a bearing is positioned as close as possible to the PTFE seal material so as to keep the sleeve stationary where it passes through the seal. It has been found that this seal design has no gas leakage and meets environmental regulations.

Today, many oil wells are located in remote regions, hundreds of miles from service facilities. In addition, these wells may produce only marginal quantities of oil. It is not economically viable to have operators on hand to monitor each of these remote, low yield wells for proper operation, as was common in the past where hundreds of wells operated side by side in vast oil fields above extensive oil reserves. Improved communications technologies allow these remote wells to be monitored automatically with sensors and measuring instruments on the well to keep track of such factors as pumping speed, oil flow, contamination, and failures. The information may then be transferred by phone line, or even satellite link, to a central maintenance facility so that repair operators can be dispatched if needed. The present invention provides a shaft seal that can operate remotely, monitor itself for failure, communicate the failure to the central repair facility, and also contain the failure until repair crews arrive, thus meeting stringent environmental regulations relating to the leakage of noxious gases into the air.

STATEMENT OF THE INVENTION

Briefly, the present invention incorporates a secondary or backup seal. This secondary seal is also located very close to the support bearing to protect the precision sealing surface. Normally the operating pressures of the well do not reach the secondary seal as they are contained by the primary seal. Hence, the secondary seal is not stressed and does not wear out. In the event of leakage past the primary seal, the secondary seal takes over the sealing function until repairs are made.

Between the primary and secondary seals, this invention incorporates a connecting port to sense any pressurized fluids or gases which would indicate a leak in the primary seal. The port connects to a pressure detector which, in turn, signals the failure through a suitable remote communications link using telephone or satellite technologies. Thus, the seal system monitors itself for failure and communicates any maintenance needs to a central repair office and also contains leaks for a sufficient time to allow the repairs to be scheduled at a convenient and economic time. Other benefits and advantages will become apparent from the following detailed description and the drawing referenced thereby.

BRIEF DESCRIPTION OF THE DRAWING

The drawing schematically shows the dual primary and secondary seal system in section, except for the drive shaft, so as to best reveal the configuration of the components within the oil well head sealing including the pressure detecting port.

DETAILED DESCRIPTION OF THE INVENTION

In the drawing, a drive head 10 is shown at the top. Drive head 10 is a standard design utilizing gears or belts to transfer rotational motion from a motor to a rod or drive shaft 12. Drive shaft 12 turns about its central axis and extends downward through a production tube or casing 14 to a progressive cavity pump 16. Pump 16 is a superior type of pump in which the drive shaft spins about its axis and rotates a down hole rotor. The rotor has a helical shape on the outside that engages an elastomeric stator with a helical shape on the inside surface so as to form cavities which progress upward, from the suction to the discharge end of the pump, carrying oil therein. These pumps are more reliable, contaminant tolerant, and lower in cost. Pump 16 lifts the oil upwards through casing 14, to a tee fitting somewhere below the seal structure, which tee is not shown in the drawing. At the tee, the oil is directed to a storage facility. However, the highly pressurized oil will also rise up inside tube 14 and bear against the primary seal bottom. It has been very hard to contain the oil at the top of the casing in the prior art because the oil is under high pressure, it usually contains salt water, sand, corrosive fluids and gases, and the packings around the rotating drive shaft need to be not too tight or else large amounts of energy are required to rotate shaft 12. In the prior art, a small amount of leakage is tolerated. A worker responds to excessive leaking by squeezing the packing a bit tighter with a compression nut above the packing. As the packing wears away, additional packing material is added to the stuffing box that surrounds the rotating shaft 12. However, this approach is impossible for remotely located wells that produce smaller quantities of oil where it is simply uneconomical to have a worker constantly watching the well head.

The drive shaft 12 is surrounded by a sleeve 20. Sleeve 20 is locked and sealed to pump shaft 12 with a cap 22 Sleeve 20 is flame sprayed with a powdered metal alloy called Colmonoy #6 so as to deposit a surface buildup of molten metal alloy. After cooling, the sleeve is machined to a tolerance of +0.000"and −0.002" on the sealing surface. A 6–8 rms surface finish is produced. The Colmonoy #6 alloy permits this accuracy and also affords a 60–65 Rc hardness for long wear. The Colmonoy #6 alloy is virtually impervious to the corrosive hydrogen sulfide gas found in many oil reserves and is also resistant to sand abrasion, arsenic and other metal buildups, and salt water corrosion.

Sleeve 20 extends downward through a self-aligning spherical ball or roller bearing 24. Shaft 12 may be thousands of feet long and out of balance in unpredictable ways. Hence, shaft 12 can whip and vibrate quite violently, with complex motions, at various frequencies. The progressive cavity pump may also add vibrations of its own due to its helical spinning configuration. This whipping exceeds the elastic response time of the PTFE seal material and could therefore generate gas leakage and seal wear. Bearing 24 is located as close as possible to the seals and holds shaft 12 and sleeve 20 in place, preventing sideways movement of sleeve 20 at the seal locations.

Bearing 24 is supported in a bearing housing 26 and bears against the sleeve 20 to hold it in place. A secondary seal housing 28 is threaded onto housing 26 with threads 30. Bearing housing 26 is itself threaded onto a primary seal housing 32 with threads 34. Contained within primary seal housing 32 is a PTFE seal 36 filled with graphite or carbon so as to be self lubricating. Seal 36 has a larger diameter bevel 38 at the top to locate it in the bore. Seal 36 is supported from above, so as to resist well pressures, by an inward extending flange 40 on bearing housing 26. Seal 36 is sealed to the bore by one or more o-rings 42. An encircling garter spring 43 urges the lower skirts 45 of seal 36 radially outward and inward. Also, well pressure tends to force skirts 45 radially outward and inward as well.

A problem with progressive cavity pumps is that, when the pumps are turned off, the column of oil falls back down the pipe, causing the rotor to spin backwards, and also forming a vacuum above the oil column that sucks the lubrication out of the seal packing. The spinning dry seal may be overheated, burned, and glazed. Since the PTFE material is self lubricating, and resistant to very high temperatures, it can withstand the backspin of shaft 12 when the well is shut down and the column of oil drops back down the casing 14. However, to better resist the vacuum, seal 36 has a upwardly slanted lip 44 that will be pulled more tightly against sleeve 20 when a vacuum is present beneath lip 44 to better seal against grease being sucked out of bearing 24.

A bronze bushing 46 supports the bottom end of sleeve 20 and locates shaft 12 to minimize whipping and vibration. A secondary seal 50, similar in design to primary seal 36, is positioned within secondary seal housing 28.

Secondary seal 50 is isolated from pressure and wear as long as primary seal 36 is properly functioning. If primary seal 36 fails, the grease packing within bearing housing 26 will become pressurized and forced up against secondary seal 50. Secondary seal 50 now takes over the sealing function until repairs are made.

To detect and signal the failure of the primary seal, a pressure detector 52 is connected with a suitable tube, indicated in the drawing by a dashed line 54, to a pressure port 56 drilled in the side of bearing housing 26. Port 56 communicates with the space between the bearings that becomes pressurized if pressure starts leaking past primary seal 36. Detector 52 is connected to a suitable remote communications link 58. Because of the high quality of the secondary seal 50, the replacement of the primary seal 36, as signaled by link 58, may be scheduled at a convenient time.

Because of the variations possible within the spirit and scope of the invention, limitation only in accordance with the following claims is appropriate.

I claim:

1. A oil well head seal system comprising in combination:

a drive shaft rotatably operable and extending from a drive head down a casing;

a high pressure progressive cavity downhole oil well pump connected to and operated by said drive shaft, a sleeve adapted to sealingly slip over said drive shaft, said sleeve having a coating providing an external hard and smooth sealing surface;

a primary seal housing adapted to connect to said casing and further having a bore therein adapted to accept said drive shaft therethrough into said casing;

a primary seal in the bore in said primary seal housing, said primary seal pressing against the external sealing surface of said sleeve, and said primary seal being sealed to said bore;

a bearing housing surrounding said sleeve and connected to said primary seal housing;

a bearing in said bearing housing and surrounding said sleeve, said bearing contacting the external sealing surface of said sleeve at a location immediately adjacent to said primary seal so as to prevent transverse movement of said sleeve against said primary seal;

a secondary seal housing about said sleeve and connected to said bearing housing; and a secondary seal in said secondary seal housing, sealed to said secondary seal housing and sealing against said external sealing surface of said sleeve.

2. The system according to claim 1 further including a space between said primary seal and said secondary seal and pressure detection means in communication with the space to detect pressure in said space as an indication of pressure leakage through said primary seal.

3. The system of claim 1 in which said primary and secondary seals comprise a filled fluorocarbon polymer material.

4. The system of claim 1 in which each of said primary and secondary seals has at least one skirt that contacts said sleeve sealing surface at an angle toward the well casing so that pressurized fluid that may leak past the primary seal presses the skirt of said secondary seal more tightly against said external sealing surface of said sleeve, and each of said primary and secondary seals has at least one lip that contacts said sleeve sealing surface at an angle away from the well casing so as to resist vacuum pressures that may develop in the well casing.

5. The system of claim 2 including remote communication links connected to said pressure detecting means so as to signal failure of said primary seal.

6. The system of claim 1 including a bushing in the bore in said primary seal housing, said bushing surrounding and supporting said drive shaft so as to further prevent transverse movement of said sleeve against said seals.

7. The system of claim 1 in which said seals are secured and sealed to said casing with o-rings positioned in circumferential grooves.

8. A self monitoring oil well head sealing system having a rotating drive shaft extending from a drive head down a casing, a high pressure progressive cavity downhole oil well pump connected to an operated by said drive shaft, a sleeve adapted to sealingly slip over said drive shaft, said sleeve having an external coating providing a hard and smooth sealing surface comprising a flame sprayed metal alloy having a surface smoothness of between +0.000 inch and −0.002 inch with a surface finish of 6–8 rms and a hardness of 60–65 Rc, a primary seal housing connected to said casing having a bore therein adapted to accept said rotating drive shaft therethrough into said casing, a primary seal in the bore of said primary seal housing, said primary seal bearing against said hard and smooth surface of said sleeve and sealed to said bore, a bearing housing surrounding said sleeve and connected to said primary seal housing, said bearing housing having a bearing contacting the hard and smooth surface of said sleeve at a location immediately adjacent to said primary seal, a secondary seal housing about said sleeve and connected to said bearing housing, and a secondary seal in said secondary seal housing, sealed to said secondary housing and sealing against said hard and smooth surface of said sleeve, said primary seal and secondary seals having a space therebetween, and a means for detecting gas and fluid pressure connected to said space between said primary and secondary seals.

9. The system of claim 8 including remote communication means connected to said means for detecting gas an fluid pressure.

10. The system of claim 8 in which each of said seals comprise at least one first skirt that contacts said sleeve sealing surface at an angle toward the well so that pressurized fluid that may have leaked from the well operates to press said skirt more tightly against the sleeve sealing surface and at least one second skirt that contacts said sleeve sealing surface at an angle away from the well so that suction pressures from the well press said second skirt more tightly against the sleeve sealing surface.

11. The system of claim 10 in which said seals comprise a filled fluorocarbon polymer material.

12. The system of claim 8 in which said seals are sealed to said casing with o-rings positioned in circumferential grooves.

13. The system of claim 12 including a bushing surrounding and supporting the drive shaft at a location between the primary seal and the casing so as to further prevent transverse movement of said drive shaft against said seals.

14. The system of claim 13 including remote communication means connected to said pressure detecting means.

15. The system of claim 11 in which the fluorocarbon polymer material is PTFE.

16. The system of claim 11 in which the fluorocarbon polymer material is filled PTFE.

17. An oil well head seal system comprising in combination:

a drive shaft rotatably operable and extending from a drive head down a casing;

a high pressure progressive cavity downhole oil well pump connected to and operated by said drive shaft;

a sleeve adapted to sealingly slip over said drive shaft, said sleeve having a coating providing an external hard and smooth sealing surface;

a primary seal housing adapted to connect to said casing and further having a bore therein adapted to accept said drive shaft therethrough into said casing;

a primary seal in the bore in said primary seal housing, said primary seal pressing against the external sealing surface of said sleeve, and said primary seal being sealed to said bore;

a bearing housing surrounding said sleeve and connected to said primary seal housing;

a bearing in said bearing housing and surrounding said sleeve, said bearing contacting the external sealing surface of said sleeve at a location immediately adjacent to said primary seal so as to prevent transverse movement of said sleeve against said primary seal;

a secondary seal housing about said sleeve and connected to said bearing housing;

a secondary seal in said secondary seal housing, sealed to said secondary seal housing and sealing against said external sealing surface of said sleeve; and wherein the external sealing surface of said sleeve is a coating of a flame sprayed metal alloy having a surface smoothness of between +0.000 inch and −0.002 inch with a surface finish of 6–8 rms and a hardness of 60–65 Rc.

* * * * *